United States Patent [19]

Fukuchi

[11] 4,270,720

[45] Jun. 2, 1981

[54] BRACKET UNIT

[75] Inventor: Shigeki Fukuchi, Tokyo, Japan

[73] Assignee: Metako Kigyo Co., Ltd., Tokyo, Japan

[21] Appl. No.: 74,751

[22] Filed: Sep. 12, 1979

[30] Foreign Application Priority Data

Sep. 12, 1979 [JP] Japan ..... 53/125937[U]

[51] Int. Cl.[3] ..... A47H 1/10

[52] U.S. Cl. ..... 248/269; 248/257

[58] Field of Search ..... 248/262, 263, 269, 265, 248/267, 268, 270, 254, 255, 256, 257, 258, 259, 260, 271, 272

[56] References Cited

U.S. PATENT DOCUMENTS

| | | | |
|---|---|---|---|
| 864,067 | 8/1907 | Bierley | 248/269 |
| 1,120,494 | 12/1914 | Hoenisch | 248/267 |
| 1,238,931 | 9/1917 | Murray | 248/259 |
| 1,520,066 | 12/1924 | Mahoney | 248/254 |
| 1,556,733 | 10/1925 | Talbot | 248/267 |
| 1,851,332 | 3/1932 | Schwarz | 248/267 |
| 2,226,581 | 12/1940 | Richardson | 248/267 X |
| 2,500,706 | 3/1950 | Roshko | 248/267 |

FOREIGN PATENT DOCUMENTS

| | | | |
|---|---|---|---|
| 286462 | 11/1967 | Australia | 248/262 |
| 2290561 | 6/1976 | France | 248/268 |

*Primary Examiner*—J. Franklin Foss

[57] ABSTRACT

A bracket unit for suspending a shaft end comprising essentially a bearing body which is provided with a curved recess for guiding and receiving the shaft end and with mounting tabs. The bearing body may be used as a bracket alone or in combination with a suspension means constructed to be coupled with the bearing body.

8 Claims, 10 Drawing Figures

BRACKET UNIT

TECHNICAL FIELD OF THE INVENTION

This invention relates to a bracket unit and more particularly to a bracket unit for suspending terminals of a shaft used in the roller screen unit.

BACKGROUND ART

Hitherto, various kinds of bracket units have been proposed and practically used. However, according to the conventionally used bracket, setting of the shaft end into the bracket is rather troublesome and inconvenient and moreover the bracket and shaft end are likely subjected to abrasion. Further, the shaft end once set in the bracket is liable to come out the bracket and thus the angle position of the bracket to be mounted is quite limited.

SUMMARY OF THE INVENTION

It is, therefore, a general object of the invention to overcome the foregoing disadvantage and inconvenience in the conventional bracket and to provide a bracket unit of simple structure which may be used at any selected angle positions without causing any undesired come-out and abrasion of the shaft end.

In accordance with the invention, there is provided a bracket unit for suspending a shaft end comprising a bearing member which is provided with a curved recess for guiding and receiving the shaft end and with two or more mounting means.

The bearing member typically comprises a cup member which includes a circumferential wall and a bottom portion integrally formed therewith. Alternatively, the bearing member comprises a base disc, a toothed intermediate member placed on the base disc, a shaft receiver which is provided with a curved recess arranged on the base disc and two or more mounting holes provided in the toothed intermediate member and all of those elements are formed integrally. The shaft receiver is preferably arranged on the toothed intermediate member through a support leg of predetermined thickness. Alternatively, toothed intermediate member may be provided on the rear side face of the base disc.

The curved recess includes a tapered recess which is provided in the circumferential wall of the cup member and a bearing recess of substantially butterfly shape which is formed in the bottom portion of the cup member in contiguous with the tapered recess. In another embodiment of the invention, the tapered recess and contiguous bearing recess are provided in the shaft receiver.

In one embodiment of the invention, the mounting means comprises two or more tabs provided at the peripheral edge of the cup member and having openings for passing therethrough convenient fasteners such as screws. In another embodiment of the invention, the mounting means comprises two or more holes which are provided in the toothed intermediate member.

Further, the cup member is provided at its circumferential edge with two or more claws adapted to engage with convenient hook means provided in the suspension means.

The bearing member thus constructed may be used alone or in combination with a convenient suspension means of substantially L shape.

The suspension means according to the invention includes a setting section of flat plate which is provided with two or more setting apertures and a coupling section for receiving and supporting the bearing member through engaging means provided therein at predetermined distances.

In one embodiment of the invention, the coupling section of the suspension means is formed with a geared recess for receiving the toothed intermediate member of the bearing member and a circular recess for receiving a base disc of the bearing member. While in another embodiment of the invention, the coupling section of the suspension means is formed with only a geared hole for receiving the toothed intermediate member of the bearing member.

The shaft receiver is preferably covered by a soft annular ring which is provided with a split.

Other objects and advantages of the invention will be more fully described with reference to the accompanying drawings illustrative of preferred embodiments of the invention in which:

PREFERRED EMBODIMENT OF THE INVENTION

Figure 1:
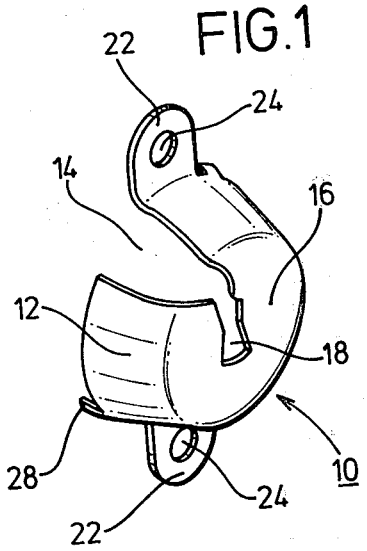
FIG. 1 is a perspective view of the bearing member according to the invention.

In FIG. 1, one embodiment of a bracket unit according to the invention comprises a bearing member of cup shape 10 including a circumferential wall section 12 which is provided with a tapered guide recess 14 and a bottom portion 16 which is provided with a bearing recess 18 in contiguous with the tapered guide recess 14.

Figure 2:
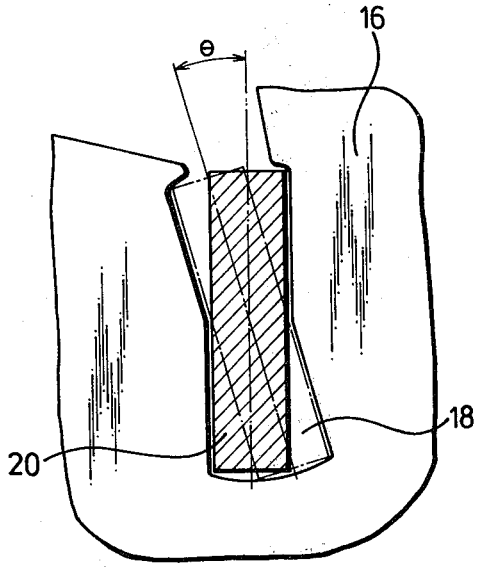
FIG. 2 is an enlarged front elevation of the bottom portion of the bearing member with the bearing recess.

As best shown in FIG. 2, the bearing recess 18 is formed into a substantially butterfly shape with an angle in contrast against a center axis passing through the butterfly-shaped recess 18 so that a shaft end 20 when inserted into the recess 18 may be somewhat swingable in the recess 18 to absorb and minimize a stress applied to the shaft end 20. Namely, where the bearing recess is formed into a rectangular shape to receive the shaft end of rectangular form in section, the corner portion of the shaft end is urged with increased stress against the wall of the bearing recess so that the corner portion of the shaft end as well as the wall of the bearing recess are subjected to abrasion after repetitive movement or turning of the shaft end in the bearing recess. On the contrary, where the bearing recess is formed into the butterfly shape as shown in FIG. 2, the shaft end of rectangular form in section is made when some stress is applied into contact with the flat wall of the bearing recess in face-by-face relation without causing any undesired abrasion.

The bearing member 10 is further symmetrically provided at its peripheral edge with mounting tabs 22, 22 having therein holes 24, 24 for passing therethrough convenient fasteners such as screws.

Figure 3:
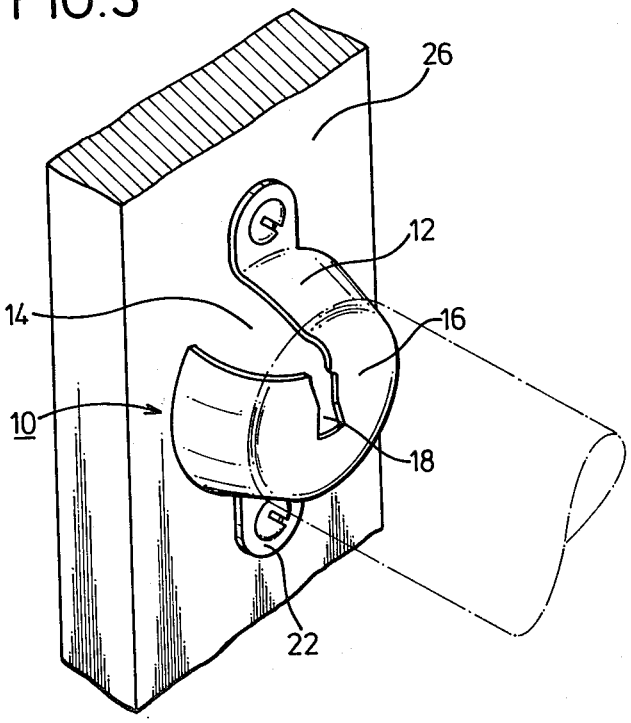
FIG. 3 is a perspective view of the bearing member mounted on the base frame.

The bearing member 10 thus constructed may be used alone by fixing the same to an appropriate support frame 26 as shown in FIG. 3.

Where the bearing member 10 is used in combination with a convenient suspension means as hereinafter described the bearing member 10 at its peripheral edge may further be provided with two or more claws 28 with predetermined distances for engagement with the convenient hooks provided in a suspension member 30.

Figure 4:
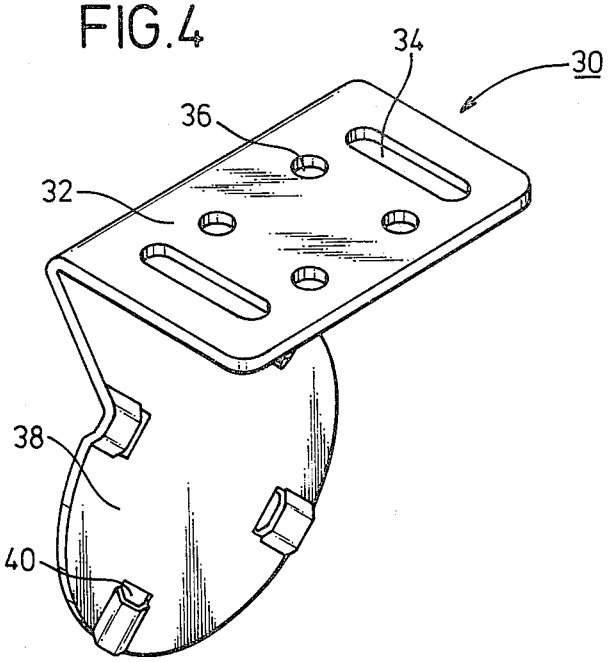
FIG. 4 is a perspective view of a suspension means according to the invention.
Figure 5:
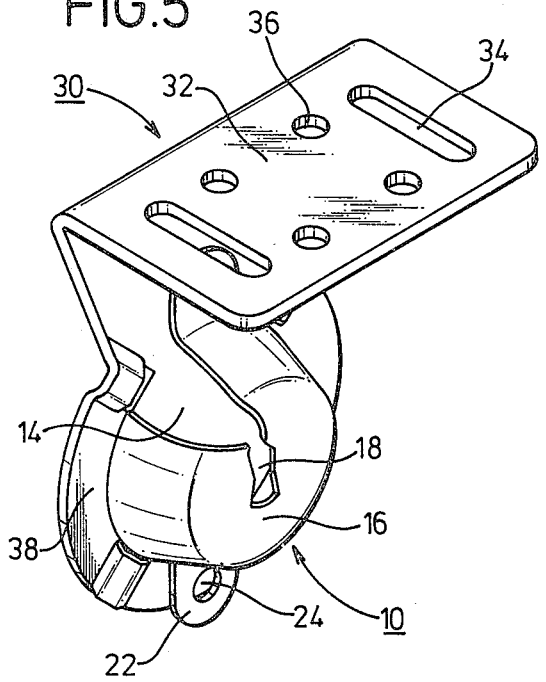
FIG. 5 is a perspective view of the suspension means coupled with the bearing member.

In FIG. 4, the suspension member 30 includes a setting section of flat plate 32 which is provided with one or more slots 34 for temporarilly mounting the setting plate 32 to the convenient base frame and with two or more setting holes 36 and a coupling section 38 for receiving and supporting the bearing member 10 through engaging holes 40 provided therein at predetermined distances as shown in FIG. 5.

Figure 6:
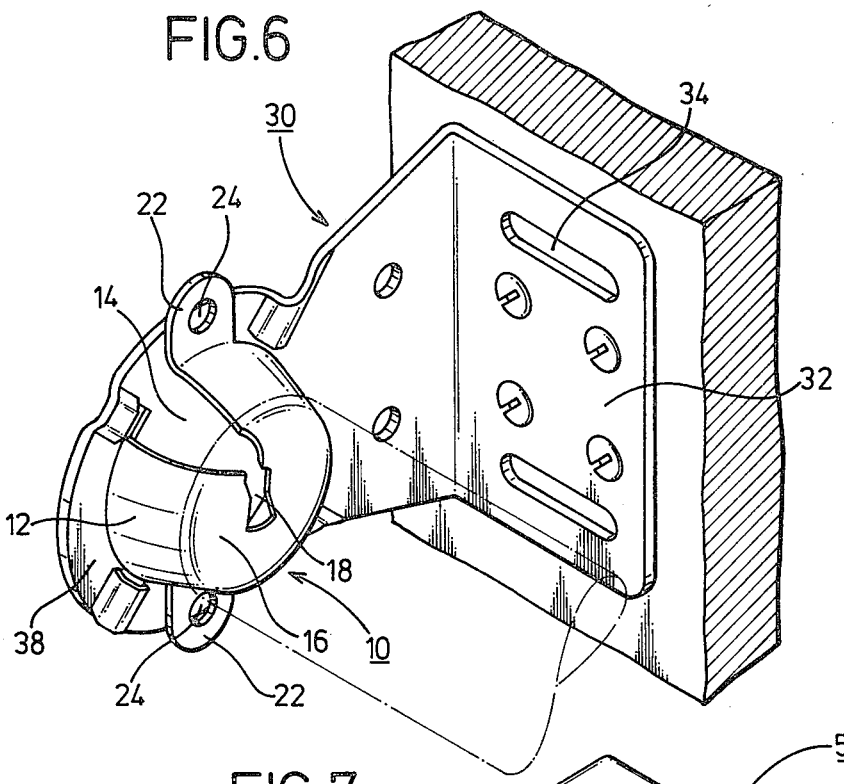
FIG. 6 is a perspective view of the bearing member with the suspension means mounted on the base frame.

It will be appreciated that the bearing member 10 may be coupled with the coupling section 38 of the suspension member 30 at any optional angle position to accord with the mounting position of the suspension member 30. For example, where the bracket unit is intended to be used in the position as shown in FIG. 5 in which the setting plate 32 is secured to an underface of the horizontal base frame such as a ceiling, the guide recess 14 with the bearing recess 18 are positioned perpendicularly. On the other hand, where the bracket unit is used in the position as shown in FIG. 6 in which the setting plate 32 is secured to a lateral face of a vertical base frame, the guide recess 14 with the bearing recess 18 are positioned laterally or in parallel with the setting plate 32.

Figure 7:
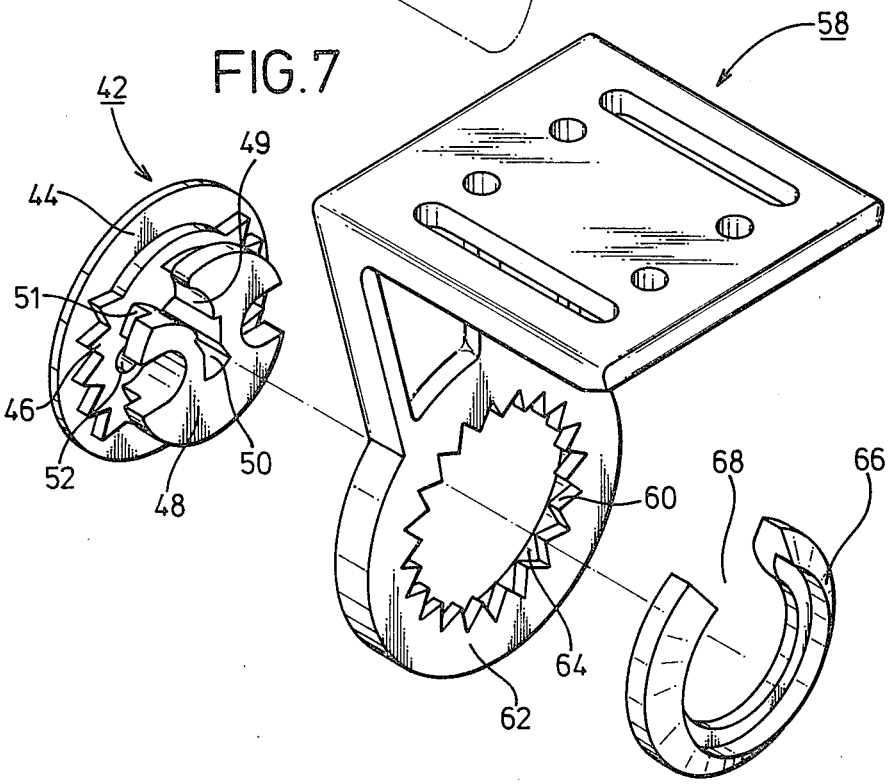
FIG. 7 is a pictorial perspective view of the bearing member with the suspension means before coupled.
Figure 8:
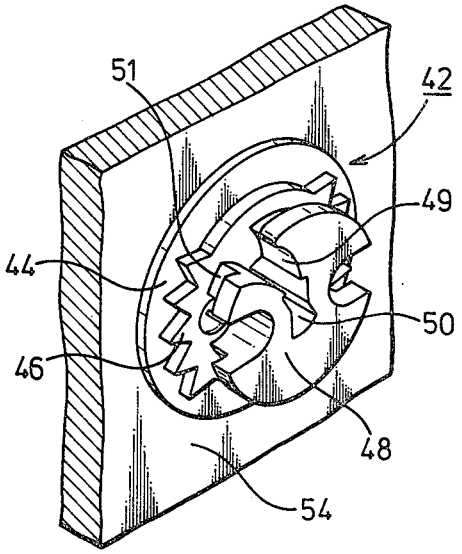
FIG. 8 is a perspective view of the bearing member of another embodiment mounted on the base frame.
Figure 9:
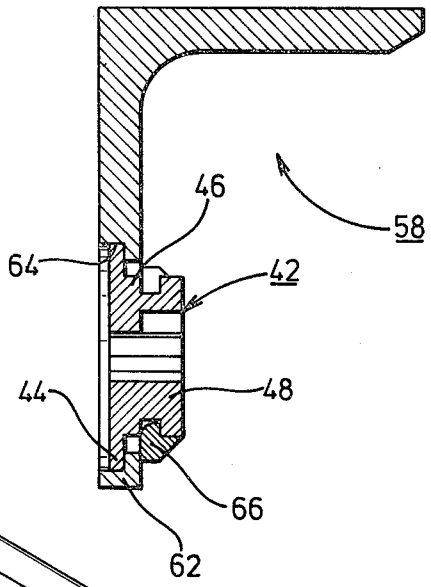
FIG. 9 is a sectional view of the bearing member coupled with the suspension means.

FIGS. 7 to 9 illustrate another embodiment of the bracket unit according to the invention wherein the bearing 42 includes a circular base disc 44 on which a toothed intermediate member 46 is integrally formed to coact with a geared recess provided in a support section of the suspension member 30.

On the toothed intermediate member 46 is further provided a shaft receiver 48 having a guide recess 49 and a bearing recess 50 through a support leg 51 all integrally formed with the intermediate member 46 and the base disc 44. The support leg 51 provides an appropriate clearance between the intermediate member 46 and the shaft receiver 48, although this support leg 51 may be dispensed if necessary according to the purpose.

In the toothed intermediate member 46 is provided two or more openings 52 for passing therethrough the convenient fasteners such as screws when the bearing member 42 alone is mounted to a convenient base frame 54 as shown in FIG. 8.

In FIG. 7, the suspension member 58 of the second embodiment has the substantially the same structure as that of the first embodiment except a geared recess 60 provided on one side face of the support section 62 for receiving the toothed intermediate member 46 and a circular recess 64 formed in an opposite side face of the support section 62 for receiving the base disc 44 as shown in FIG. 9.

The reference numeral 66 represents an elastic annular ring with an split 68 for covering the shaft receiver 48 when coupled with the suspension member 58. It will be appreciated that the bearing member 42 of this second embodiment may also be conveniently coupled with the suspension member 58 at any optional angle of the guide recess 49 and the bearing recess 50 as desired to accord with the position of the suspension member 58 as hereinbefore described in connection with the first embodiment.

Figure 10:
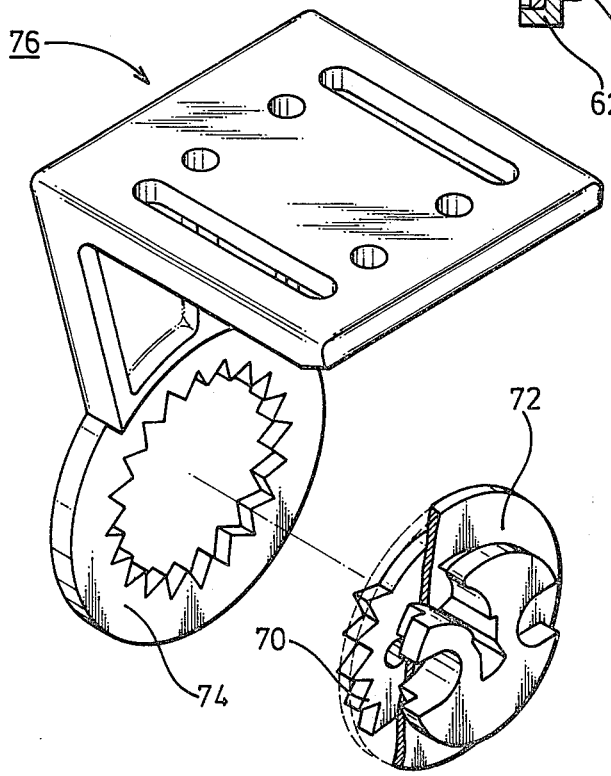
FIG. 10 is a pictorial perspective view of the suspension means with the bearing member of further embodiment.

FIG. 10 shows a further embodiment of the bracket unit similar to that of the second embodiment except a toothed intermediate member 70 which is provided in this third embodiment on the rear side of the disc member 72. Further, a support section 74 of a suspension member 76 is only provided with a geared hole for receiving the toothed member 70. The bearing member of this third embodiment may also be used alone or in coupled with the suspension member like the first and second embodiments.

As hereinbefore fully described, in accordance with the bracket unit of the invention, the shaft end is conveniently and smoothly inserted into the bearing recess through the curved recess which serves to disturb undesired come-out of the shaft end from the bracket. Moreover, the bearing member when used in association with the suspension means may be positioned at any desired angle position by merely changing position of engagement of the bearing member with the suspension means.

Without further elaboration, the foregoing will so fully illustrate the invention that others may, by applying the current or future knowledge, readily adapted the same for use under various conditions of service.

What is claimed is:

1. A suspension assembly for the shaft of a window shade or the like, comprising an arrangement of plate like elements coaxially secured about a central axis in side by side relationship with one another, consisting of a base element, a peripherally toothed element and a shaft receiver element having a slot extending from its periphery generally arcuately toward the central axis, and; a bracket adapted to be secured to a fixed support, said bracket having a plate like portion in which is formed an aperture having an internal edge of a diameter and tooth configuration conforming to that of the peripherally toothed element to receive the same coaxially therein, in any position of rotation about the central axis.

2. The assembly according to claim 1, wherein said toothed element is integrally formed on said base and said shaft receiver element is integrally formed on said toothed element.

3. The assembly according to claim 2 including a circumferential recess in said shaft receiver element adjacent said toothed element, and a resilient clamp insertable therein to secure said first assembly to said bracket.

4. The assembly according to claim 1, wherein said toothed element is integrally formed on one side of said base and said shaft receiver is integrally formed on the other side of said base element.

5. The assembly according to claim 4 including a circumferential recess in said shaft means adjacent said base and resilient clamp means insertable therein whereby said first assembly is secured to said bracket.

6. The assembly according to claim 1, wherein the flat surface of the bracket is provided with a recess for receiving said base plate element.

7. The assembly according to claim 1, wherein the arcuate slot includes a tapered recess portion and a continuous bearing recess of substantially butterfly shape.

8. The assembly according to claim 1, wherein said suspension bracket is L-shaped, said aperture being formed in one leg, the other leg having holes for introduction of fastening means for securement to the fixed support.

* * * * *